US009958198B2

(12) United States Patent
Rusignuolo et al.

(10) Patent No.: US 9,958,198 B2
(45) Date of Patent: May 1, 2018

(54) EMBEDDED CARGO SENSORS FOR A REFRIGERATION SYSTEM

(71) Applicant: Carrier Corporation, Farmington, CT (US)

(72) Inventors: Giorgio Rusignuolo, Manlius, NY (US); Stephen Varga, Bedford, NH (US); Thibaut Gavignet, Liverpool, NY (US); Greg Deldicque, Farmington, CT (US); Yu H. Chen, Manlius, NY (US)

(73) Assignee: CARRIER CORPORATION, Farmington, CT (US)

( * ) Notice: Subject to any disclaimer, the term of this patent is extended or adjusted under 35 U.S.C. 154(b) by 357 days.

(21) Appl. No.: 14/707,892

(22) Filed: May 8, 2015

(65) Prior Publication Data

US 2015/0345847 A1 Dec. 3, 2015

Related U.S. Application Data

(63) Continuation-in-part of application No. 13/382,389, filed as application No. PCT/US2010/041532 on Jul. 9, 2010.

(60) Provisional application No. 61/224,994, filed on Jul. 13, 2009.

(51) Int. Cl.
*F25D 29/00* (2006.01)

(52) U.S. Cl.
CPC ..... *F25D 29/003* (2013.01); *F25D 2500/04* (2013.01); *F25D 2700/02* (2013.01); *F25D 2700/12* (2013.01); *F25D 2700/16* (2013.01)

(58) Field of Classification Search
CPC .. B60H 1/3232; F25D 2700/16; F25D 29/003
See application file for complete search history.

(56) References Cited

U.S. PATENT DOCUMENTS

| | | | |
|---|---|---|---|
| 561,986 | A | 6/1896 | Gall |
| 4,505,126 | A | 3/1985 | Jones et al. |
| 4,519,215 | A | 5/1985 | Barnett |

(Continued)

FOREIGN PATENT DOCUMENTS

| | | | |
|---|---|---|---|
| CN | 1146240 | A | 3/1997 |
| CN | 1475720 | A | 2/2004 |

(Continued)

OTHER PUBLICATIONS

Chinese First Office Action and Search Report for application CN 201080031531.7, dated Dec. 10, 2013, 11 pages.

(Continued)

*Primary Examiner* — Ljiljana Ciric
*Assistant Examiner* — Alexis Cox
(74) *Attorney, Agent, or Firm* — Cantor Colburn LLP

(57) ABSTRACT

A method and system for use with a volume containing a cargo having a thermal mass includes, at least one temperature sensor associated with the cargo to provide at least one temperature associated with the thermal mass, a refrigeration unit associated with the volume, and a controller to control the refrigeration unit in response to the at least one temperature associated with the thermal mass and a temperature set point, wherein the controller models a temperature characteristic of the thermal mass.

14 Claims, 2 Drawing Sheets

(56) References Cited

U.S. PATENT DOCUMENTS

| | | | | |
|---|---|---|---|---|
| 4,936,104 | A | 6/1990 | Hicke | |
| 5,101,643 | A | 4/1992 | Hicke | |
| 5,152,152 | A * | 10/1992 | Brickner | B60H 1/00978 62/126 |
| 5,579,648 | A | 12/1996 | Hanson et al. | |
| 5,913,890 | A * | 6/1999 | Lee | F24F 11/0078 236/49.3 |
| 5,979,173 | A | 11/1999 | Tyree | |
| 5,983,655 | A | 11/1999 | Kistner et al. | |
| 6,027,031 | A | 2/2000 | Reason et al. | |
| 6,304,803 | B1 * | 10/2001 | Dao | B60H 1/00971 165/140 |
| 7,249,921 | B2 | 7/2007 | McMahon et al. | |
| 8,763,423 | B2 | 7/2014 | Tattam | |
| 2001/0045096 | A1 * | 11/2001 | Tatter | F25D 29/00 62/129 |
| 2002/0061758 | A1 * | 5/2002 | Zarlengo | G01D 21/00 455/517 |
| 2003/0000237 | A1 * | 1/2003 | Hansen | F25B 1/10 62/228.4 |
| 2003/0024256 | A1 | 2/2003 | Hanson | |
| 2003/0195668 | A1 * | 10/2003 | Radtke | H04B 3/548 701/1 |
| 2004/0172954 | A1 | 9/2004 | Hanson et al. | |
| 2004/0226309 | A1 * | 11/2004 | Broussard | F25D 11/003 62/236 |
| 2006/0181413 | A1 | 8/2006 | Mostov | |
| 2006/0219842 | A1 | 10/2006 | Shell et al. | |
| 2007/0185687 | A1 | 8/2007 | Speasl et al. | |
| 2007/0267509 | A1 | 11/2007 | Witty et al. | |
| 2008/0104976 | A1 | 5/2008 | Guglielmetti et al. | |
| 2008/0129493 | A1 | 6/2008 | Fuentes et al. | |
| 2008/0262646 | A1 | 10/2008 | Breed | |
| 2008/0289354 | A1 | 11/2008 | Dudley et al. | |
| 2009/0026263 | A1 | 1/2009 | Schmid et al. | |
| 2011/0193710 | A1 | 8/2011 | McIlvain et al. | |
| 2012/0111044 | A1 | 5/2012 | Chen et al. | |
| 2012/0137713 | A1 | 6/2012 | Duraisamy et al. | |
| 2012/0198866 | A1 | 8/2012 | Zeidner | |
| 2012/0227427 | A1 | 9/2012 | Liu et al. | |
| 2013/0019961 | A1 | 1/2013 | Rogers | |
| 2013/0048647 | A1 | 2/2013 | Farrar et al. | |
| 2013/0158828 | A1 | 6/2013 | McAlister | |
| 2013/0247594 | A1 | 9/2013 | Sanders et al. | |
| 2013/0247598 | A1 | 9/2013 | Fulmer et al. | |
| 2013/0247599 | A1 | 9/2013 | Love et al. | |
| 2013/0340444 | A1 | 12/2013 | Bryant et al. | |
| 2014/0144161 | A1 | 5/2014 | Pointer et al. | |
| 2014/0170949 | A1 | 6/2014 | Dwiggins | |
| 2014/0352913 | A1 | 12/2014 | Eowsakul | |
| 2015/0013357 | A1 | 1/2015 | Stockbridge et al. | |

FOREIGN PATENT DOCUMENTS

| | | | |
|---|---|---|---|
| CN | 1701205 | A | 11/2005 |
| EP | 0235119 | A2 | 9/1987 |
| EP | 0495464 | A2 | 7/1992 |
| EP | 0602936 | A2 | 6/1994 |
| EP | 0962343 | A2 | 12/1999 |
| EP | 1152316 | A2 | 11/2001 |
| EP | 1667059 | A1 | 6/2006 |
| GB | 2254506 | A | 10/1992 |
| JP | H03181766 | A | 8/1991 |
| JP | H06241637 | A | 9/1994 |
| KR | 1003092780000 | B1 | 12/2001 |
| WO | 2009073034 | A1 | 6/2009 |

OTHER PUBLICATIONS

Chinese Second Office Action for application CN 201080031531.7, dated Jul. 10, 2014, 10 pages.

Chinese Third Office Action for application CN 201080031531.7, dated Jan. 16, 2015, 10 pages.

International Preliminary Report on Patentability dated Jan. 26, 2012 (6 pages).

International Search Report and Written Opinion for application PCT/US2010/041532, dated Feb. 24, 2011, 9 pages.

International Search Report for application PCT/US2010/041532, dated Jul. 13, 2009, 3 pages.

Singapore Examination Report and Search Report for Singapore Patent Applicaiton No. 201201134-2, Jan. 23, 2014, 9 pages.

European Search Report for application EP 10800359.1, dated Sep. 21, 2015, 6 pages.

European Search Report for application 16168597.9, dated Oct. 7, 2016, 10 pages.

* cited by examiner

EMBEDDED CARGO SENSORS FOR A REFRIGERATION SYSTEM

CROSS REFERENCE TO RELATED APPLICATIONS

This patent application is a Continuation-In-Part Application of U.S. Non-Provisional patent application Ser. No. 13/382,389, filed Jan. 5, 2012, which is a National Stage Entry of PCT/US10/41532, filed Jul. 9, 2010, which claims priority from U.S. Provisional Patent Application Ser. No. 61/224,994, filed Jul. 13, 2009, all of which are incorporated herein by reference in their entirety.

BACKGROUND

The subject matter disclosed herein relates to cargo sensors, and to a system and a method for monitoring cargo sensors for control of a refrigeration system.

Typically, cold chain distribution systems are used to transport and distribute temperature sensitive and perishable goods. For example, food and pharmaceuticals may be susceptible to temperature variations. Advantageously, cold chain systems allow perishable and environmentally sensitive goods to be effectively transported and distributed without damage or other undesirable effects.

Air temperature sensors are often used in cold chain distribution systems to monitor the conditions and integrity of the cold chain and consequently the goods transported. Current air temperature sensors monitor air temperatures but may not reflect actual cargo temperatures at the surface of the cargo or within the cargo at an embedded location. A system and method that can control a refrigeration system in response to temperature information of the cargo is desired.

BRIEF SUMMARY

According to an embodiment, a refrigeration system for use with a volume containing a cargo having a thermal mass includes, at least one temperature sensor associated with the cargo to provide at least one temperature associated with the thermal mass, a refrigeration unit associated with the volume, and a controller to control the refrigeration unit in response to the at least one temperature associated with the thermal mass and a temperature set point, wherein the controller models a temperature characteristic of the thermal mass.

In addition to one or more of the features described above, or as an alternative, further embodiments could include that at least one of the at least one temperature sensor is disposed adjacent to the cargo.

In addition to one or more of the features described above, or as an alternative, further embodiments could include that at least one of the at least one temperature sensor is embedded in the cargo.

In addition to one or more of the features described above, or as an alternative, further embodiments could include at least one air temperature sensor associated with the volume.

In addition to one or more of the features described above, or as an alternative, further embodiments could include a fuel level sensor.

In addition to one or more of the features described above, or as an alternative, further embodiments could include a door sensor associated with the volume.

In addition to one or more of the features described above, or as an alternative, further embodiments could include a sun load sensor.

In addition to one or more of the features described above, or as an alternative, further embodiments could include that the controller redirects an airflow direction of the refrigeration unit in response to the at least one temperature.

In addition to one or more of the features described above, or as an alternative, further embodiments could include that the at least one temperature sensor are wirelessly associated with the controller.

In addition to one or more of the features described above, or as an alternative, further embodiments could include that the refrigeration system is at least one of remotely monitored and remotely managed.

In addition to one or more of the features described above, or as an alternative, further embodiments could include that the refrigeration system is at least one of remotely monitored and remotely managed.

In addition to one or more of the features described above, or as an alternative, further embodiments could include that the controller monitors an alarm status in response to the at least one temperature.

In addition to one or more of the features described above, or as an alternative, further embodiments could include that the temperature set point is selected by a user.

In addition to one or more of the features described above, or as an alternative, further embodiments could include that the temperature set point is selected from a reference table.

According to an embodiment, a method for controlling a refrigeration system, includes providing a refrigeration unit associated with a volume containing a cargo, wherein the cargo has a thermal mass, providing at least one temperature associated with the thermal mass to a controller via at least one temperature sensor, modelling a temperature characteristic of the thermal mass via the controller, selecting a temperature set point via a user, and controlling the refrigeration unit in response to the at least one temperature associated with the thermal mass and the temperature set point via the controller.

In addition to one or more of the features described above, or as an alternative, further embodiments could include disposing at least one of the at least one temperature sensor adjacent to the cargo.

In addition to one or more of the features described above, or as an alternative, further embodiments could include embedding at least one of the at least one temperature sensor in the cargo.

In addition to one or more of the features described above, or as an alternative, further embodiments could include that the refrigeration system is at least one of remotely monitored and remotely managed.

In addition to one or more of the features described above, or as an alternative, further embodiments could include monitoring an alarm status in response to the at least one temperature via the controller.

In addition to one or more of the features described above, or as an alternative, further embodiments could include selecting the temperature set point via a user.

In addition to one or more of the features described above, or as an alternative, further embodiments could include selecting the temperature set point via a reference table.

Technical function of the embodiments described above includes at least one temperature sensor associated with the cargo to provide at least one temperature associated with the thermal mass, a refrigeration unit associated with the volume, and a controller to control the refrigeration unit in response to the at least one temperature associated with the thermal mass and a temperature set point, wherein the controller models a temperature characteristic of the thermal mass.

Other aspects, features, and techniques of the embodiments will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the FIGURES:

DETAILED DESCRIPTION

Figure 1:
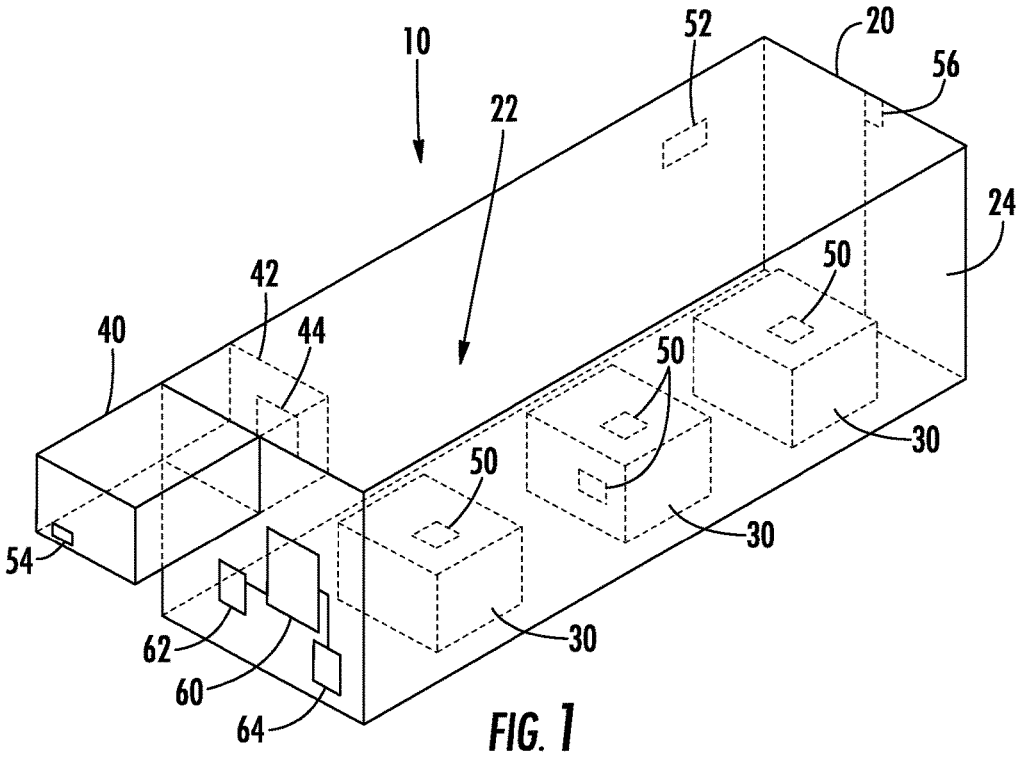
FIG. 1 illustrates a schematic view of an exemplary refrigeration system for use with an embodiment.

Referring now to the drawings, FIG. 1 illustrates a schematic view of an exemplary embodiment of a refrigeration system 10. Refrigeration system 10 may include a container 20, cargo 30, refrigeration unit 40, temperature sensors 50, and controller 60. In an exemplary embodiment, refrigeration system 10 is utilized to provide a desired temperature and humidity range to cargo 30 within container 20. Advantageously, embodiments described herein provide intelligent solutions to controlling the temperature of cargo 30 by monitoring surface and embedded temperatures of cargo 30 and utilizing the characteristics of the thermal mass of the cargo 30 to run refrigeration system 10 in an optimized manner. In certain embodiments, feedback from additional sensors is utilized to further control refrigeration system 10.

In an exemplary embodiment, refrigeration system 10 controls the climate of volume 22 of a container 20. In certain embodiments container 20 can be pulled by a tractor. It is understood that embodiments described herein may be applied to shipping containers that are shipped by rail, sea, or any other suitable container, without use of a tractor. The container 20 may define an interior volume 22. In an exemplary embodiment container 20 can include at least one door 24 to allow access to volume 22 within.

In an exemplary embodiment, container 20 contains cargo 30 in an interior volume 22. In an exemplary embodiment, cargo 30 is a temperature sensitive cargo, including, but not limited to food, drugs, blood, and other temperature sensitive materials. In an exemplary embodiment, cargo 30 and elements of cargo 30 have a thermal mass that can act as a thermal accumulator. In certain embodiments, the thermal accumulation properties of cargo 30 allow cargo 30 to maintain a cargo temperature as well as affect a surrounding air temperature. In certain embodiments, the thermal mass of cargo 30 changes temperatures slower than the surrounding air of volume 22. In certain embodiments, the thermal mass of cargo 30 changes faster than the surrounding air of volume 22. In certain embodiments, the thermal mass of cargo 30 can have a varying characteristic wherein certain portions of cargo 30 can change temperatures at varying rates.

In an exemplary embodiment, refrigeration system 10 includes one or more refrigeration units 40. Refrigeration unit 40 can provide refrigerated, dehumidified, or otherwise climate controlled air to the volume 22 of container 20. In an exemplary embodiment, climate controlled air is utilized to control the temperature of cargo 30. In an exemplary embodiment, refrigeration unit 40 includes an evaporator side 42 disposed within volume 22 of container 20. In certain embodiments, an air handler 44 directs climate controlled air within the volume 22 of the container 20. In certain embodiments, the air handler 44 can be actuated in response to inputs from controller 60.

In an exemplary embodiment, sensors 50 are utilized with cargo 30. Sensors 30 can provide desired environmental parameters such as temperature, humidity, and other conditions associated with cargo 30. In certain embodiments, a user can maintain and monitor temperatures or other parameters monitored by sensors 50 within an acceptable range. In certain embodiments, sensors 50 can be wired or wireless sensors.

In an exemplary embodiment, sensors 50 can be disposed in various locations with respect to the cargo 30. In certain embodiments, sensors 50 are disposed on the surface of cargo 30. In certain embodiments, sensors 50 are embedded within the cargo 30. In certain embodiments, embedded sensors 50 can provide a core temperature of cargo 30. Advantageously, compared to traditional refrigeration systems, temperature readings are taken at the surface or at an embedded location of the cargo 30, allowing controller 60 to receive temperature and other information regarding the cargo 30. Further, sensor 50 locations allow the thermal accumulation characteristics of cargo 30 to be determined and utilized by controller 60.

In certain embodiments, refrigeration system 10 includes at least one air temperature sensor 52. Air temperature sensor 52 can provide information about the air temperature within the volume 22. In certain embodiments, an air temperature sensor 52 is associated with the delivery or output air stream from refrigeration unit 40. In certain embodiments, another air temperature sensor 52 is associated with the return air stream to refrigeration unit 40. Advantageously, air temperature sensors 52 can provide additional information to controller 60 regarding the air temperature within volume 22 and the relationship between the air temperatures and cargo 30 temperatures, as monitored by sensors 50.

In certain embodiments, refrigeration system 10 can include a fuel level sensor 54 to provide information about the fuel level of the fuel source used to provide energy to the refrigeration system 10. In certain embodiments, controller 60 can utilize the information to control the duty cycle and output of refrigeration system 10.

In certain embodiments, container 20 can include a door sensor 56 to monitor the state of door 24 of container 20. In certain embodiments, the door state of door 24 can be used to control certain operations of refrigeration system 10.

In certain embodiments, container 20 can include a sun load sensor 58 to monitor the angle and intensity of sun experienced by container 20. Advantageously, parameters from sun load sensor 58 can be utilized by controller 60 to control the duty cycle and output of refrigeration system 10.

In an exemplary embodiment, controller 60 receives inputs from sensors 50 to control refrigeration system 10. In certain embodiments, controller 60 receives additional information from refrigeration unit 40, air temperature sensor 52, fuel level sensor 54, door sensor 56, etc. In certain embodiments, controller 60 can autonomously control temperatures within volume 22 without any additional user intervention. Controller 60 can manage refrigeration unit 40 operation in response to sensor feedback and information, based on the temperature set point established by a user. In certain embodiments, controller 60 can direct air flow from refrigeration unit 40 via air handler 44 to direct refrigerated air as needed.

In an exemplary embodiment, controller 60 can utilize temperature readings from sensors 50 disposed on the surface of cargo and sensors 50 embedded within cargo 30. Further, air temperature sensor 52 can provide air temperatures within volume 22, supply air stream, and return air stream.

In an exemplary embodiment, controller 60 can compare temperature readings from sensors 50 against predetermined set points to determine refrigeration unit 40 operations. In certain embodiments, temperature readings from sensors 50 can be utilized to determine thermal accumulation properties of cargo 30. A plurality of sensors 50 can be utilized to form a temperature profile of cargo 30 to determine how temperatures vary over time for the thermal mass of cargo 30.

Advantageously, by determining thermal accumulation properties of cargo 30, transient temperature response of cargo 30 can be utilized to optimize operation of the refrigeration unit 40. For example, if cargo 30 has a high thermal accumulation characteristic, cargo 30 may take a longer time between refrigeration cycles compared to cargo 30 with a lower thermal accumulation characteristic. In an exemplary embodiment, control 60 can model the thermal mass and thermal accumulation characteristics to determine optimal operation and direction of air streams via air handler 44.

In an exemplary embodiment, controller 60 can calculate when to turn refrigeration unit on and off based on the different cargo and air temperature read as well as the set point and other parameters (such as refrigerant pressures, etc.). Therefore, in accordance with controller 60 programming or user inputs, the output of refrigeration unit 40 can be directly adjusted according to the temperature of the cargo 30 and thermal mass characteristics. In certain embodiments, the air handler 44 can be adjusted to reroute air to portions of volume 22 to maintain a temperature within the cargo 30. In certain embodiments, controller 60 can utilize additional information during operation, such as information from door sensor 56 and fuel level sensor 54. For example, if door 24 is determined to be open, refrigeration unit 40 may be disengaged. Similarly, if fuel levels reported by fuel level sensor 54 are low, refrigeration unit 40 may be disengaged or controller 60 may prioritize fuel economy during optimization routines. In certain embodiments, controller 60 can adjust and adapt air flow, power saving states, duty cycles, engine speeds, start stop regimes, etc. In certain embodiments, set points can be established by users. In other embodiments, set points can be referenced from a table of predetermined values and/or an algorithm based on cargo parameters (such as cargo type, destination, etc.), environmental parameters, and user parameters.

Advantageously, sensors 50 can provide accurate cargo 30 temperatures instead of, or in addition to, air temperature of volume 22. Controller 60 can utilize this information to increase efficiency of refrigeration unit 40, conserve fuel, prevent damage to cargo, etc.

In certain embodiments, sensors 50, air temperature sensor 52, fuel level sensor 54, door sensor 56, and sun load sensor 58 can be wireless. In an exemplary embodiment, wireless transceiver 62 sends and receives wireless signals from the sensors 50, air temperature sensor 52, fuel level sensor 54, door sensor 56, and sun load sensor 58 and facilitates communication to controller 60.

In certain embodiments, refrigeration system 10 can receive instructions and send operation data to a remote location via wide area network interface 64. The wide area network utilized may be any suitable network, including, but not limited to cellular networks, satellite communication networks, private wide area networks, etc. In certain embodiments, wide area network interface 64 communicates with a shipper, a receiver, a customer, etc. In certain embodiments, communication distances are state wide, country wide, or international.

Advantageously, wide area network transmissions of refrigeration system 10 operations (including, but not limited to sensor 50 data, air temperature sensor 52 data, fuel level sensor 54 data, door sensor 56 data, etc.) described above allows for real time monitoring of the relevant parameters. In certain embodiments, wide area network transmissions can facilitate remote troubleshooting of refrigeration system 10. Further, wide area network transmissions can facilitate real time cargo rerouting and cargo loss prevention in the event of equipment failure or a breach of container 20. Additionally, sensor readouts from certain sensors, such as fuel level sensor 54 can be provided for fleet management purposes.

In certain embodiments, controller 60 can generate alarms in response to cargo temperature deviations from set temperatures and/or air temperature deviations from a predetermined value. Controller 60 can display alarm status, store alarm triggers, etc. In certain embodiments, alarm conditions can be transmitted via wide area network 64.

Figure 2:
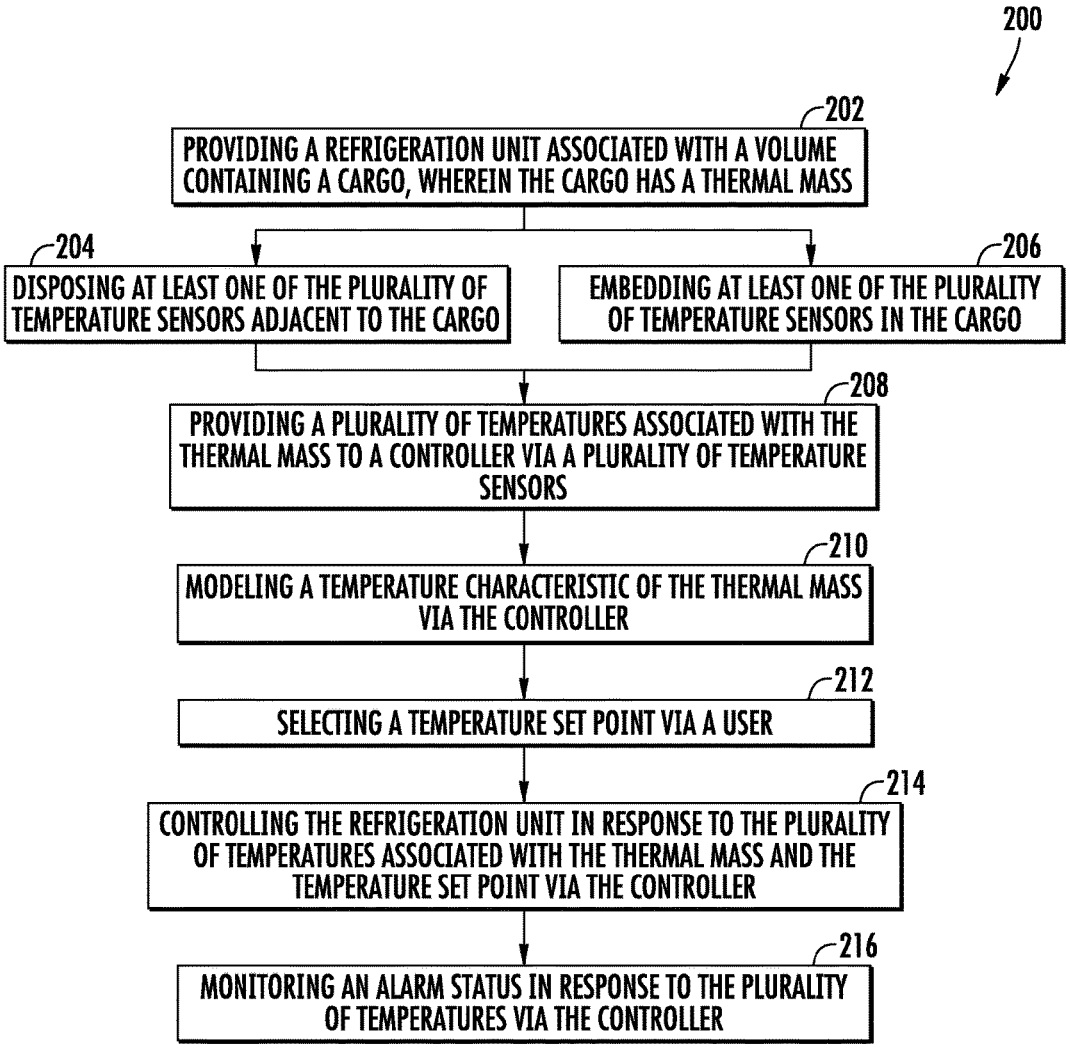
FIG. 2 is a flowchart illustrating a method controlling a refrigeration system.

Referring to FIG. 2, a method 200 for controlling a refrigeration system 10 is shown. In an exemplary embodiment, the refrigeration system utilized is similar to refrigeration system 10 described above. In operation 202, a refrigeration unit is provided, wherein the output of the refrigeration unit is associated with a volume containing a cargo. In an exemplary embodiment, the volume associated with the refrigeration unit can be a volume of a container. The cargo contained within the volume can have a thermal mass as described above. Advantageously, by modeling the thermal mass, thermal accumulation characteristics can be utilized for optimized operation of the refrigeration unit.

In operation 204, sensors are disposed adjacent to the cargo. In an exemplary embodiment, sensors are temperature sensors that are disposed on the surface of the cargo. Advantageously, sensors disposed on the surface of the cargo provide an accurate reading of the surface temperature of the cargo for refrigeration operations.

In operation 206, alternatively, or in addition to surface mounted sensors, sensors may be embedded within the cargo. In an exemplary embodiment, sensors are temperature sensors disposed or embedded within the cargo.

In operation 208, a plurality of temperatures taken from surface mounted or embedded sensors is provided to a controller. In an exemplary embodiment, temperatures taken from sensors are associated with the thermal mass of the cargo.

In operation 210, temperature characteristics of the thermal mass are modeled via the controller. In an exemplary embodiment, a controller is utilized to control the refrigeration unit. Advantageously, temperature characteristics can be analyzed and utilized to provide optimal refrigeration operations. For example, if the thermal mass of the cargo is determined to have high thermal accumulation characteristics, a controller may configure the refrigeration unit to run less frequently for longer durations. Further, if the thermal mass of the cargo is determined to have a relatively low thermal accumulation characteristic, a controller may configure the refrigeration unit to run more frequently at lower durations depending on thermal characteristics, cargo specifications, environmental demands, etc. In certain embodiments, sensor input from various sensors can be utilized, including but not limited to door sensors, fuel level sensors, sun load sensors, etc.

In operation 212, the controller can accept or calculate acceptable set points in response to the cargo temperatures with respect to the thermal accumulation properties of cargo and other characteristics. In certain embodiments, a user selects a temperature set point via a user interface or via a remote interface associated with the controller. Therefore, in accordance with controller programming or user inputs, the output of refrigeration unit can be directly adjusted according to the temperature of the cargo and thermal mass characteristics.

In operation 214, the refrigeration unit is operated by the controller. The controller may contain predefined temperature set points or may create adaptive set points in response to the thermal characteristics of the cargo. In an exemplary embodiment, control signals are sent to the refrigeration unit to activate, deactivate, change settings and vary direction of air flow in response to controller input.

In operation 216, the controller can monitor cargo temperature deviations from set temperatures and/or air temperature deviations from a predetermined value. In response the controller can generate alarm conditions, store alarm triggers, etc. In certain embodiments, alarm conditions can be transmitted via a wide area network.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. A refrigeration system, for use with a volume containing a cargo having a thermal mass, the refrigeration system comprising:

at least two temperature sensors associated with the cargo to provide at least two temperatures associated with the thermal mass, wherein the first temperature sensor is disposed on an outside surface of the cargo, and wherein the second temperature sensor is embedded within the cargo;

a refrigeration unit associated with the volume; and a controller configured to:

model a thermal accumulation characteristic of the thermal mass based at least in part on the at least two temperatures; and control the refrigeration unit based at least in part on the modeled thermal accumulation characteristic and a temperature set point.

2. The refrigeration system of claim 1, further comprising at least one air temperature sensor associated with the volume.

3. The refrigeration system of claim 1, further comprising a fuel level sensor, wherein the controller is configured to control the refrigeration unit based at least in part on the modeled thermal accumulation characteristic, the set point, and an output of the fuel level sensor.

4. The refrigeration system of claim 1, further comprising a door sensor associated with the volume, wherein the controller is configured to control the refrigeration unit based at least in part on the modeled thermal accumulation characteristic, the set point, and an output of the door sensor.

5. The refrigeration system of claim 1, further comprising a sun load sensor, wherein the controller is configured to control the refrigeration unit based at least in part on the modeled thermal accumulation characteristic, the set point, and an output of the sun load sensor.

6. The refrigeration system of claim 1, wherein the controller redirects an airflow direction of the refrigeration unit in response to the at least one temperature.

7. The refrigeration system of claim 1, wherein the at least two temperature sensors are wirelessly associated with the controller.

8. The refrigeration system of claim 1, wherein the refrigeration system is at least one of remotely monitored and remotely managed.

9. The refrigeration system of claim 1, wherein the controller monitors an alarm status in response to the at least two temperatures.

10. The refrigeration system of claim 1, wherein the temperature set point is selected by a user.

11. A method for controlling a refrigeration system, comprising:

providing a refrigeration unit associated with a volume containing a cargo, wherein the cargo has a thermal mass;

providing at least two temperatures associated with the thermal mass to a controller via at least two temperature sensors, wherein the first temperature sensor is disposed on an outside surface of the cargo, and wherein the second temperature sensor is embedded within the cargo;

modelling a thermal accumulation characteristic of the thermal mass based at least in part on the at least two temperatures via the controller; and controlling the refrigeration unit based at least in part on the modeled thermal accumulation characteristic of the thermal mass and a temperature set point via the controller.

12. The method of claim 11, wherein the refrigeration system is at least one of remotely monitored and remotely managed.

13. The method of claim 11, further comprising monitoring an alarm status in response to the at least two temperatures via the controller.

14. The method of claim 11, wherein the temperature set point is selected by a user.

* * * * *